US006443646B1

(12) United States Patent
MacDonald

(10) Patent No.: US 6,443,646 B1
(45) Date of Patent: Sep. 3, 2002

(54) GRILL BRUSH

(76) Inventor: Alan G. MacDonald, 684 Beach Blvd., Hamilton, Ontario (CA), L8H 6Y4

( * ) Notice: Subject to any disclaimer, the term of this patent is extended or adjusted under 35 U.S.C. 154(b) by 0 days.

(21) Appl. No.: 09/853,481

(22) Filed: May 11, 2001

(51) Int. Cl.[7] ..... A46B 11/00

(52) U.S. Cl. ..... 401/39; 401/286; 401/282; 401/25; 401/37

(58) Field of Search ..... 401/286, 282, 401/268, 25, 39, 37, 16, 269; 15/111

(56) References Cited

U.S. PATENT DOCUMENTS 1,818,917 A * 8/1931 Wolf ..... 301/25
2,772,430 A * 12/1956 Moritt ..... 15/111
4,074,944 A 2/1978 Xavier
4,286,349 A 9/1981 Dugrenier
4,830,674 A 5/1989 Kaufman
4,875,791 A 10/1989 Hassan
5,007,754 A * 4/1991 Zierhut ..... 401/269
D334,665 S 4/1993 Johnson
5,775,827 A 7/1998 Packham et al.
6,125,493 A * 10/2000 Daw ..... 15/111

* cited by examiner

*Primary Examiner*—David J. Walczak

(57) ABSTRACT

A grill brush for cleaning the grates of a grill while also applying cleaning oil. The grill brush includes a head portion having a plurality of bristles and a scraping portion for removing debris from the grate of the grill, along with the capability to supply cleaning oil to the bristles.

7 Claims, 2 Drawing Sheets

GRILL BRUSH

BACKGROUND OF THE INVENTION

2. Field of the Invention

The present invention relates to grill brushes and more particularly pertains to a new grill brush for cleaning the grates of a grill while also applying cleaning oil.

2. Description of the Prior Art

The use of grill brushes is known in the prior art. More specifically, grill brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,830,674; 4,074,944; 4,286,349; 5,775,827; 4,875,791; and U.S. Patent No. Des. 334,665.

While these devices fulfill their respective, particular objectives and requirements, the aforementioned patents do not disclose a new grill brush. The inventive device includes a head portion having a plurality of bristles and a scraping portion for removing debris from the grate of the grill, along with a means for automatically supplying cleaning oil to the bristles.

In these respects, the grill brush according to the present invention substantially departs from the conventional concepts and designs of the prior art, and in so doing provides an apparatus primarily developed for the purpose of cleaning the grates of a grill while also applying cleaning oil.

SUMMARY OF THE INVENTION

In view of the foregoing disadvantages inherent in the known types of grill brushes now present in the prior art, the present invention provides a new grill brush construction wherein the same can be utilized for cleaning the grates of a grill while also applying cleaning oil.

The general purpose of the present invention, which will be described subsequently in greater detail, is to provide a new grill brush apparatus and method which has many of the advantages of the grill brushes mentioned heretofore and many novel features that result in a new grill brush which is not anticipated, rendered obvious, suggested, or even implied by any of the prior art grill brushes, either alone or in any combination thereof.

To attain this, the present invention generally comprises a head portion having a plurality of bristles and a scraping portion for removing debris from the grate of the grill, along with a means for automatically supplying cleaning oil to the bristles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new grill brush apparatus and method which has many of the advantages of the grill brushes mentioned heretofore and many novel features that result in a new grill brush which is not anticipated, rendered obvious, suggested, or even implied by any of the prior art grill brushes, either alone or in any combination thereof.

It is another object of the present invention to provide a new grill brush which may be easily and efficiently manufactured and marketed.

It is a further object of the present invention to provide a new grill brush which is of a durable and reliable construction.

An even further object of the present invention is to provide a new grill brush which is susceptible of a low cost of manufacture with regard to both materials and labor, and which accordingly is then susceptible of low prices of sale to the consuming public, thereby making such grill brush economically available to the buying public.

Still yet another object of the present invention is to provide a new grill brush which provides in the apparatuses and methods of the prior art some of the advantages thereof, while simultaneously overcoming some of the disadvantages normally associated therewith.

Still another object of the present invention is to provide a new grill brush for cleaning the grates of a grill while also applying cleaning oil.

Yet another object of the present invention is to provide a new grill brush which includes a head portion having a plurality of bristles and a scraping portion for removing debris from the grate of the grill, along with a means for automatically supplying cleaning oil to the bristles.

Still yet another object of the present invention is to provide a new grill brush that would be used to evenly apply cooking oil onto the grill grate to ease the task of grilling.

Even still another object of the present invention is to provide a new grill brush that would help prevent corrosion and increase the effective use of the grill.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
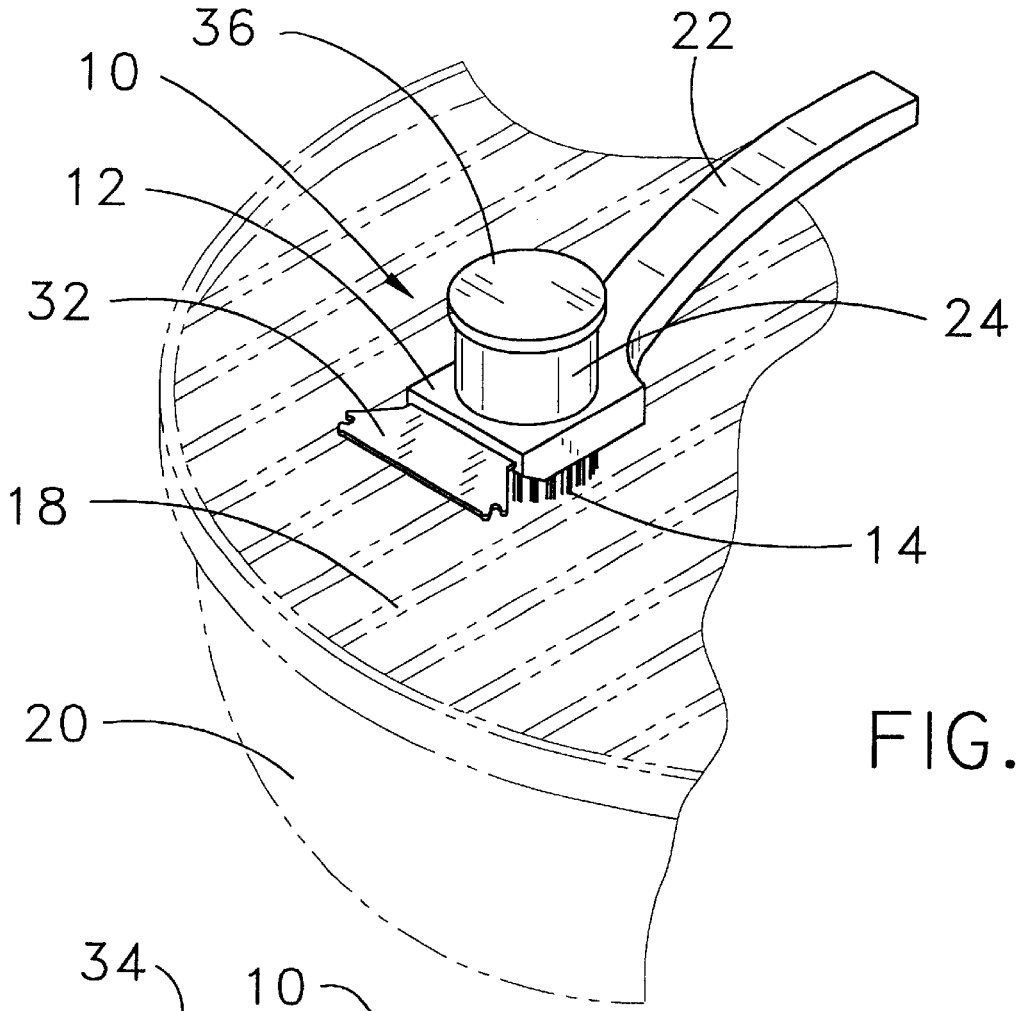
FIG. 1 is a schematic perspective view of a new grill brush in use according to the present invention.
Figure 2:
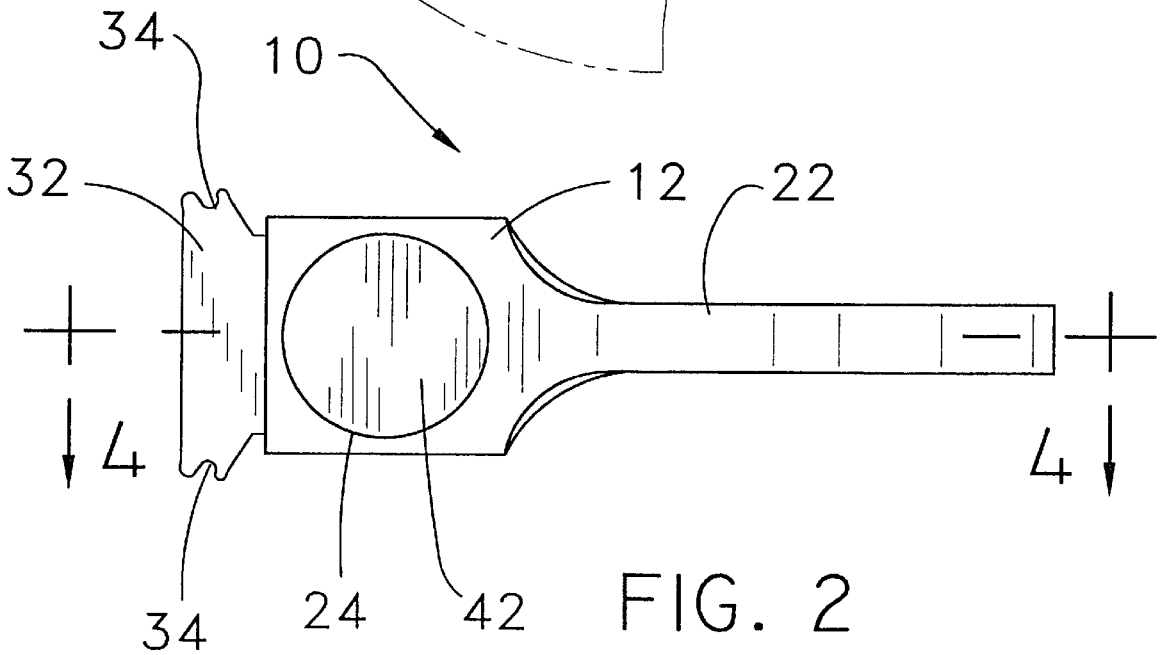
FIG. 2 is a schematic top view of the present invention.
Figure 3:
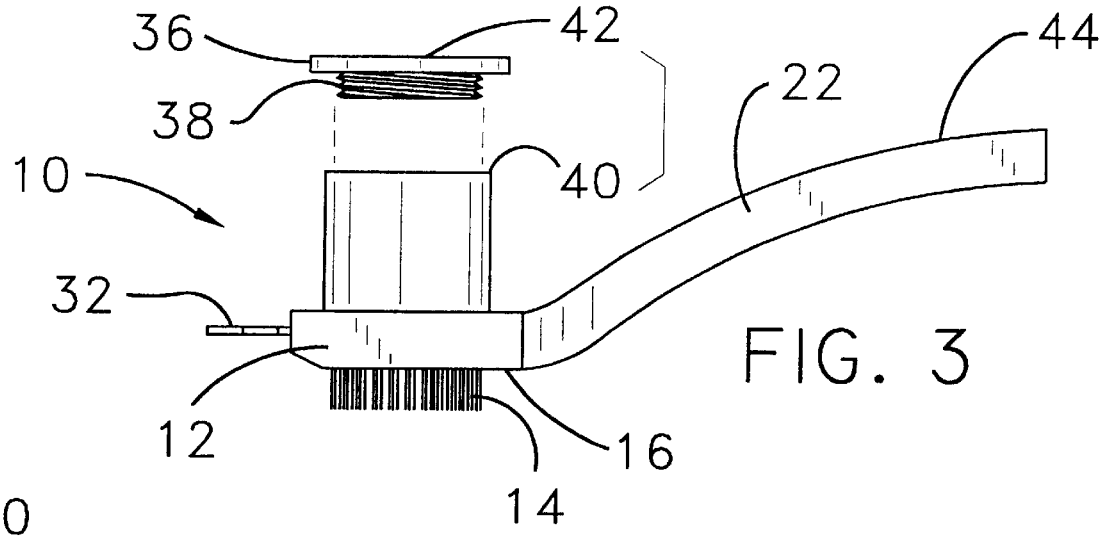
FIG. 3 is a schematic side view of the present invention.
Figure 4:
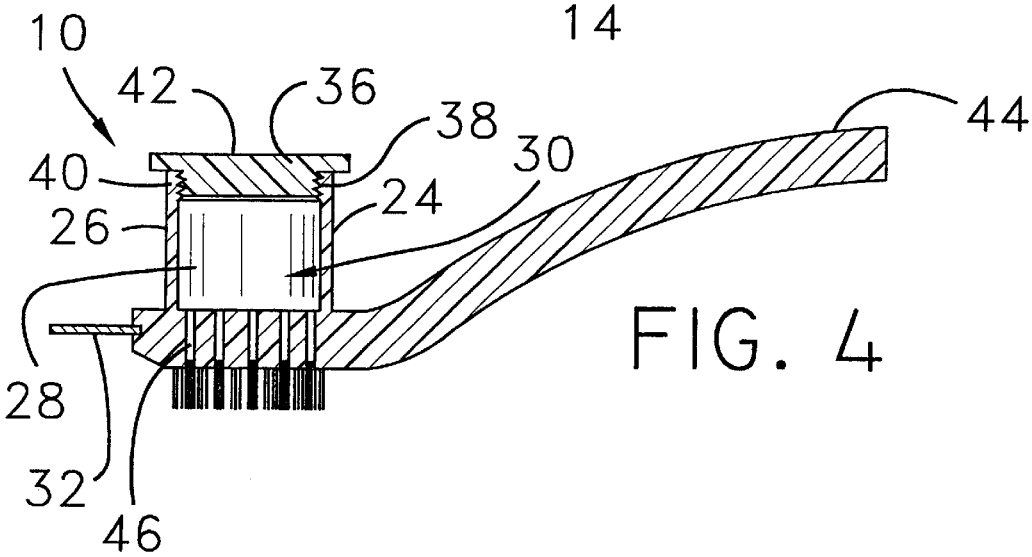
FIG. 4 is a schematic cross-sectional side view of the present invention.
Figure 5:
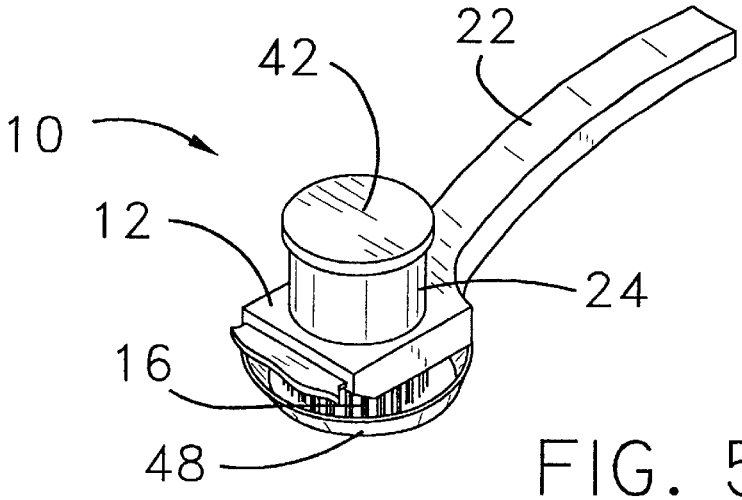
FIG. 5 is a schematic perspective view of the present invention in the storage position.

With reference now to the drawings, and in particular to FIGS. 1 through 5 thereof, a new grill brush embodying the principles and concepts of the present invention and generally designated by the reference numeral 10 will be described.

As best illustrated in FIGS. 1 through 5, the grill brush 10 generally comprises a head portion 12 including a plurality of bristles 14 extending downward from a cleaning face 16 of the head portion 12. The bristles 14 are designed for scrubbing debris from the grate 18 of the grill 20.

A handle portion 22 extends outward from the head portion 12, and is designed for being gripped by the hand of a user when the bristles 14 are scrubbed against the gate of the grill 20.

The head portion 12 includes a fluid containment portion 24 positioned opposite the bristles 14.

The fluid containment portion 24 includes a peripheral wall 26 defining a storage space 28. The storage space 28 of the fluid containment portion 24 is in fluid communication with the bristles 14.

The fluid containment portion 24 is designed for supplying oil 30 to the bristles 14 for oiling the grate 18 of the grill 20 when the bristles 14 are scrubbed against the grate 18 of the grill 20.

A blade 32 is coupled to the head portion 12 opposite the handle portion 22 for scraping debris from the grate 18 of the grill 20.

The blade 32 includes a plurality of arcuate cutouts 34 positioned at opposing corners of a distal end of the blade 32. Each of the arcuate cutouts 34 is designed for receiving one of a plurality of bars of the grate 18 of the grill 20 for scraping debris from the grate 18 of the grill 20.

A lid 36 is provided for selectively coupling to the fluid containment portion 24. The lid 36 is designed for preventing oil 30 contained in the fluid containment portion 24 from splashing out when the lid 36 is coupled to the fluid containment portion 24.

The lid 36 includes a threaded portion 38 for threadably engaging an upper end 40 of the storage space 28.

The lid 36 includes a planar top surface 42. The top surface 42 of the lid 36 is coplanar with a free end 44 of the handle for resting on a support surface for storage such that oil 30 contained within the fluid containment portion 24 is prevented from flowing 30 to the bristles 14.

The head portion 12 includes a plurality of bores 46, each extending between the storage space 28 of the fluid containment portion 24 and the bristles 14.

Each of the bores 46 is for permitting fluid communication between the storage space 28 of the fluid containment portion 24 and the bristles 14 when the bristles 14 are scrubbed against the grate 18 of the grill 20.

A storage tray 48 abuts against the head portion 12 such that the bristles 14 are positionable within the storage tray 48. The storage tray 48 is designed for protecting the bristles 14 from being damaged while being stored.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grill brush for cleaning a grate of a grill, the grill brush comprising:

a head portion having a plurality of bristles extending downwardly from a cleaning face of said head portion, said bristles being adapted for scrubbing debris from the grate of the grill;

a handle portion extending outwardly from said head portion, said handle portion being adapted for being gripped by the hand of a user when said bristles are scrubbed against the grate of the grill;

said head portion having a fluid containment portion positioned opposite said bristles, said fluid containment portion having a peripheral wall defining a storage space, said storage space of said fluid containment portion being in fluid communication with said bristles such that said fluid containment portion is adapted for supplying oil to said bristles for oiling the grate of the grill when said bristles are scrubbed against the grate of the grill;

a lid being for selectively coupling to said fluid containment portion, said lid being adapted for preventing oil contained in said fluid containment portion from splashing out of said fluid containment portion when said lid is coupled to said fluid containment portion; and said lid having a planar top surface, said top surface of said lid being coplanar with a free end of said handle, said top surface of said lid and said free end of said handle being adapted for resting on a support surface for storage such that oil contained within said fluid containment portion is prevented from being in communication with said bristles.

2. The grill brush as set forth in claim 1, further comprising:

a blade being coupled to said head portion opposite said handle portion, said blade being adapted for scraping debris from the grate of the grill.

3. The grill brush as set forth in claim 2, further comprising:

said blade having a plurality of arcuate cut outs, each of said arcuate cut outs being positioned at opposite corners of a distal end of said blade, each of said arcuate cut outs being adapted for receiving one of a plurality of bars of the grate of the grill for scraping debris from the bar of the grate of the grill.

4. The grill brush as set forth in claim 1, further comprising:

said lid having a threaded portion, said threaded portion being for threadably engaging an upper end of said storage space, said lid being adapted for sealing oil within said fluid containment portion when said lid is coupled to said fluid containment portion.

5. The grill brush as set forth in claim 1, further comprising:

said head portion having a plurality of bores, each of said bores extending between said storage space of said fluid containment portion and said bristles, each of said bores being for permitting fluid communication between said storage space of said fluid containment portion and said bristles when said bristles are being scrubbed against the grate of the grill.

6. The grill brush as set forth in claim 1, further comprising:

a storage tray being for abutting against said head portion such that said bristles are positioned with said storage tray, said storage tray being adapted for protecting said bristles from being damaged when being stored.

7. A grill brush for cleaning a grate of a grill, the grill brush comprising:

a head portion having a plurality of bristles extending downwardly from a cleaning face of said head portion, said bristles being adapted for scrubbing debris from the grate of the grill;

a handle portion extending outwardly from said head portion, said handle portion being adapted for being gripped by the hand of a user when said bristles are scrubbed against the grate of the grill;

said head portion having a fluid containment portion positioned opposite said bristles, said fluid containment portion having a peripheral wall defining a storage space, said storage space of said fluid containment portion being in fluid communication with said bristles such that said fluid containment portion is adapted for supplying oil to said bristles for oiling the grate of the grill when said bristles are scrubbed against the grate of the grill;

a lid being for selectively coupling to said fluid containment portion, said lid being adapted for preventing oil contained in said fluid containment portion from splashing out of said fluid containment portion when said lid is coupled to said fluid containment portion;

said lid having a planar top surface, said top surface of said lid being coplanar with a free end of said handle, said top surface of said lid and said free end of said handle being adapted for resting on a support surface for storage such that oil contained within said fluid containment portion is prevented from being in communication with said bristles;

a blade being coupled to said head portion opposite said handle portion, said blade being adapted for scraping debris from the grate of the grill;

said blade having a plurality of arcuate cut outs, each of said arcuate cut outs being positioned at opposite corners of a distal end of said blade, each of said arcuate cut outs being adapted for receiving one of a plurality of bars of the grate of the grill for scraping debris from the bar of the grate of the grill;

said lid having a threaded portion, said threaded portion being for threadably engaging an upper end of said storage space, said lid being adapted for sealing oil within said fluid containment portion when said lid is coupled to said fluid containment portion;

said head portion having a plurality of bores, each of said bores extending between said storage space of said fluid containment portion and said bristles, each of said bores being for permitting fluid communication between said storage space of said fluid containment portion and said bristles when said bristles are being scrubbed against the grate of the grill;

a storage tray being for abutting against said head portion such that said bristles are positioned with said storage tray, said storage tray being adapted for protecting said bristles from being damaged when being stored.

* * * * *